US005514843A

United States Patent [19]

Wilfong et al.

[11] Patent Number: 5,514,843

[45] Date of Patent: May 7, 1996

[54] PRESSURE-COMPENSATED KEY SWITCH

[76] Inventors: James A. Wilfong, 2727 Victoria Manor, San Carlos, Calif. 94070; Dave J. Gilman, 135 Putnam St., San Francisco, Calif. 94110

[21] Appl. No.: 216,716

[22] Filed: Mar. 23, 1994

[51] Int. Cl.[6] ..... H01H 9/00; H01H 25/00

[52] U.S. Cl. ..... 200/5 R; 200/6 A; 200/18; 200/339

[58] Field of Search ..... 200/5 R, 5 A, 200/512–517, 302.1–302.3, 5 E–5 EB, 553–563, 308–317, 17 R, 18, 339, 5 B

[56] References Cited

U.S. PATENT DOCUMENTS

| | | | |
|---|---|---|---|
| 3,691,324 | 9/1972 | Brantingson | 200/5 E |
| 4,022,993 | 5/1977 | Shattuck | 200/5 A |
| 4,060,703 | 11/1977 | Everett, Jr. | 200/5 A |
| 4,256,931 | 3/1981 | Palisek | 200/5 A |
| 4,386,254 | 5/1983 | Eberhardt et al. | 200/339 |
| 4,520,240 | 5/1983 | Swindler | 200/5 R |
| 4,654,488 | 3/1987 | Westfall | 200/5 R |
| 4,687,200 | 8/1987 | Shirai | 200/5 A X |
| 4,760,218 | 7/1988 | Gutman | 200/5 R |
| 4,920,243 | 4/1990 | Yuge | 200/314 |
| 4,929,804 | 5/1990 | Kawai et al. | 200/5 A |
| 4,992,631 | 2/1991 | Gee | 200/5 A |
| 5,164,554 | 11/1992 | Ikunami | 200/5 E |
| 5,283,401 | 2/1994 | Schmucker | 200/6 A |
| 5,332,874 | 7/1994 | Orr et al. | 200/5 B |

OTHER PUBLICATIONS

IEE RAFI, RF 15/19 Flat Data Entry Systems from Industrial Electronic Engineers, Inc of Van Nuys, California.

*Primary Examiner*—J. R. Scott

[57] ABSTRACT

A pressure-compensated key switch that actuates when a force is applied to an individual key but does not actuate when a uniform pressure is applied to all of the keys. The pressure-compensated key switch includes at least two keys arranged approximately symmetrically about, and balanced on, a pivot. A switch mechanism actuates when a force that offsets the balance and depresses one of the keys. The uniform pressure applied equally to all the keys will not depress or actuate any of the keys. When an individual key is depressed, a pad made of conductive material contacts and bridges a gap between two electrodes to complete an electrical path. The bridging of the gap is the actuation of the switch mechanism. The pressure-compensated key switch is typically part of a system that includes an electrical device to sense completion of the electrical path. A spring returns the key to its un-depressed position when no depressing force is applied. The keys are covered by a flexible membrane that makes a waterproof seal with a housing. An optional light source may illuminate the keys from below by shining through the keys and flexible membrane. Due to its balanced design the pressure-compensated key switch may be used underwater at depths as great as hundreds of feet without being actuated by the uniform water pressure and may be used at sea level without requiring an excessive force to depress the keys.

28 Claims, 7 Drawing Sheets

PRESSURE-COMPENSATED KEY SWITCH

FIELD OF THE INVENTION

This invention relates generally to mechanically actuated switches and more specifically to mechanically actuated key switches.

BACKGROUND OF THE INVENTION

Key switches are used to enter information in many electronic products such as computers, telephones, home appliances, toys, cameras, and military equipment. These switches actuate when a key is depressed by a user. The key returns as soon as it is released.

Many mechanically actuated switch types have been invented and are in use, including proximity switches, toggle switches, rotary switches, slide switches, and others. All these switch types have some features that offer some benefits. Key switches offer a set of features—light actuation force, quick action, automatic return, slight feeling of resistance to motion, compactness, ergonomic design, and a motion well-adapted for repetitive finger motions of humans—that is not available as a combination in other switch types. Computers, telephones, and many other electronic products use key switches almost universally for entering alphanumeric characters quickly, conveniently, and repetitively.

A typical key switch includes a key, a pad made of material that conducts electricity, a spring, two electrodes, a support, a housing, and an optional light. Depressing the key moves the pad to a position in which it contacts and forms a bridge between the two electrodes. When this bridge is formed, an electrical path is completed. Completion of the electrical path is the actuation of the key switch. The spring supports the key so that key will not depress unless some outside force is applied. The spring also gives the user a feeling of light resistance when he depresses the key, and returns the key back into its original position ready for the next use as soon as the key is released. To actuate the key switch the user must depress the key with enough force to overcome the spring force. The support is typically a printed circuit board but may be any surface that supports the spring. The housing has apertures for the keys and attaches to the support. A complete system typically includes a sensor in the electronic product that detects when the electrical path has been completed by the formation of a bridge between the electrodes. In some designs, such as an "oilcan" dome or a rubber "button," the key, the pad, and the spring may be the same part. In other designs these elements are separate parts.

In some key switches the depression of the key moves the pad to a position that causes a change in the capacitance or electrical field about a single electrode. In these key switches the pad changes its position relative to an electrode but does not necessarily make contact with that electrode. A complete system typically includes a sensor in the electronic product that senses the change in capacitance or electric field. Alternatively, the pad may be made of a magnetic material. The depression of the key moves the magnetic material to a position that causes a change in the inductance or magnetic field. The complete system typically includes a circuit that senses the change in the inductance or magnetic field.

A "switch mechanism," as used herein, refers to a device that actuates when compressed and returns automatically to its un-compressed position when the compression force is released. A spring means included in the switch mechanism acts to return the switch mechanism to its un-compressed position. Typically, the actuation of the switch mechanism is the completion of an electrical path between two leads of the switch mechanism, but other methods of actuation such as a change in capacitance or inductance are alternatives. Switch mechanisms typically mount on a printed circuit board but may be mounted and wired to any approximately flat surface. Commercially available switch mechanisms are often used as a part of a key switch in order to take advantage of the relatively low cost and good reliability that the manufacturers of the switch mechanisms have gained through their experience and volume of production. Switch mechanisms known as "microswitches" are available commercially from Honeywell, Murata-Erie, and ITT. Another type of switch mechanism known as a membrane switch is available from Bergquist, Tadco, or IEE.

Each key may be an individual part, such as the keys for a common personal desktop computer keyboard. A key cap or a flexible membrane may cover the key itself. Or, a matrix of keys may be molded in one piece out of a flexible material such as the keypads used in many inexpensive telephones. In most cases the key, key cap, flexible membrane, or keypad is identified with letters, numbers, or other mark that indicate the function of the key.

A light source is sometimes used to illuminate the keys. The illuminated keys and flexible membrane or key cap, if present, are made of translucent material. The light source may illuminate the keys from below by shining through the key and covering, if present, so that the location of the the keys and their identifying marks are visible in the dark. The light source may be a light emitting diode (LED), incandescent light, electroluminescent (EL) light, gas discharge light, or other source of illumination. The light source may be placed to shine directly through the keys and flexible membrane or placed so that its light is carried by an optical fiber or reflected by a reflector to shine through the keys and flexible membrane. Some commercial switch mechanisms may include the light source.

Some electronic products, such as handheld radios, cellular phones, ruggedized handheld computers, surveying equipment, navigation equipment including GPS receivers, and similar equipment, are used out-of-doors where they may be rained upon or used in and around swimming pools, rivers, lakes, bays, and oceans. In such environments, the electronic product may be unintentionally or intentionally taken a few feet underwater. These products and the switches they use therefore need to be waterproof to be reliable. Key switches may be designed to be waterproof through the use of a flexible membrane overlaying the switch, use of a diaphragm beneath the key, use of an O-ring around a shaft connecting to a key, use of a keypad compressed between housing parts, and by other methods.

Electronic products intended for deep water applications such as marine salvage, scuba diving, underwater defense and warfare, offshore mineral and oil diving, underwater archeology, and commercial divesuit fishing must not only be waterproof but also must operate at the ambient pressure from sea level to a few hundred feet underwater. Users in these applications will sometimes work from sea level, or above, to two hundred feet underwater in the course of a single day's activity.

Pressure increases by approximately 14.7 pounds per square inch for each 33 feet of depth of sea water or each 35 feet of fresh water. At 200 feet under sea water a key with a surface of 0.5 inches×0.5 inches, or 0.25 square inches, has a force of over 20 pounds acting to depress it. In theory, one could design a key switch with a spring force slightly greater than the force that would be generated due to the water pressure at the maximum depth that the product would be used. For example, a product intended for 200 feet but no deeper would be designed with a spring force on each key of 20+ pounds. The problem with this approach is that at sea level, the user would have to push with 20+ pounds in order to operate the keys! Even a user with strong fingers finds it inconvenient to push more than a few ounces repeatedly. A product with keys that requires pounds of force would be exceedingly difficult to use over time. Another design approach would be to reduce the force on the keys due to water pressure by reducing the surface area of the keys. The problem with this approach is that the users engaged in deep water applications usually wear thick gloves to protect and keep their hands warm. Smaller keys become more difficult to use when wearing thick gloves.

What is needed is a pressure-compensated key switch with the combination of features of a key switch—light actuation force, quick action, automatic return, slight feeling of resistance to motion, compactness, ergonomic design, and a motion well-adapted for repetitive finger motions of humans—that is waterproof and that operates with light finger pressure from sea level to a few hundred feet below the surface.

SUMMARY OF THE INVENTION

The present invention is a pressure-compensated key switch that actuates with a light finger force applied to a single key but does not actuate with a heavy force acting equally on all keys. This invention uses a pivot to balance equal forces applied to two or more keys so that even a strong uniform pressure will not depress any key individually to actuate a corresponding switch mechanism. On the other hand, a relatively light force applied to an individual key will upset the balance across the pivot causing the corresponding switch mechanism to actuate.

The key switch according to the invention includes two or more keys that are arranged symmetrically about a pivot, each key being associated with a switch mechanism that actuates when compressed and returns the key when the compressing force is released. The keys are covered by a flexible membrane that makes a waterproof seal with a housing. Optionally, a light source positioned beneath keys may be used to illuminate the keys from below by shining through the key and flexible membrane.

The keys are arranged about the pivot so that the force due to a uniform external environmental pressure is symmetrical about the pivot. For instance, two keys of equal surface areas must be on a straight line on opposite sides and at equal distances from the pivot. The key surfaces are not required to be equal in area. Two keys with unequal surface areas must be on a straight line on opposites sides and at distances from the pivot that are inversely proportional to their respective surface areas. Four keys may be arranged at the ends of a cross pattern. An even or odd number of keys may be arranged in a pattern at the ends of spokes as are found in a wheel. Or, the keys may be positioned in a spoke-type arrangement in which the spokes are of differing lengths. In general, two or more keys may be arranged in any manner about a center pivot so that their combined moment or "area weighted center of gravity" is zero. Key surfaces may have arbitrary shapes.

DETAILED DESCRIPTION OF THE INVENTION

Figure 1:
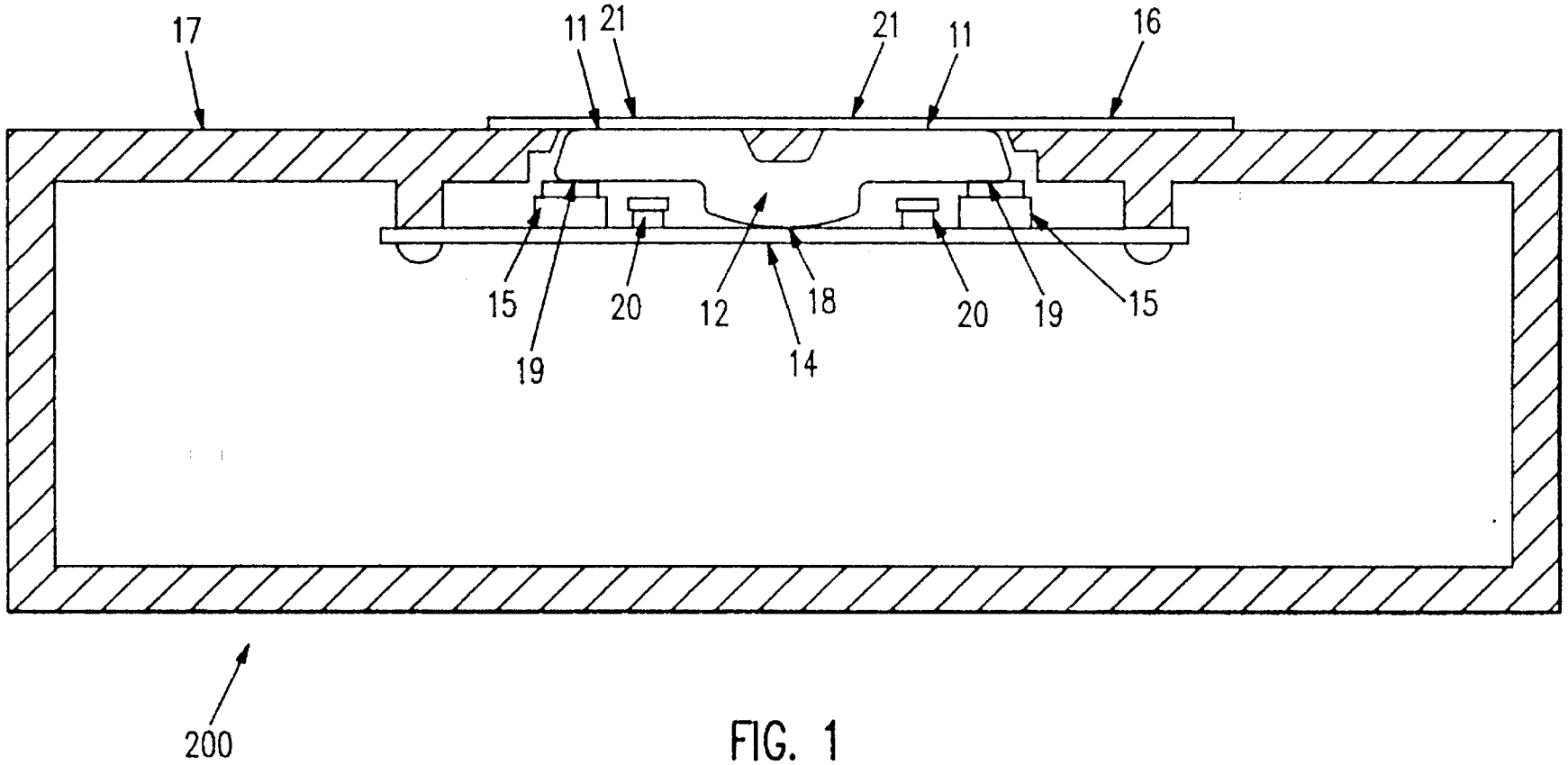
FIG. 1 is a side cross section view of a first embodiment of a pressure-compensated key switch of the present invention having a pivot line about which the key switch pivots.
Figure 2:
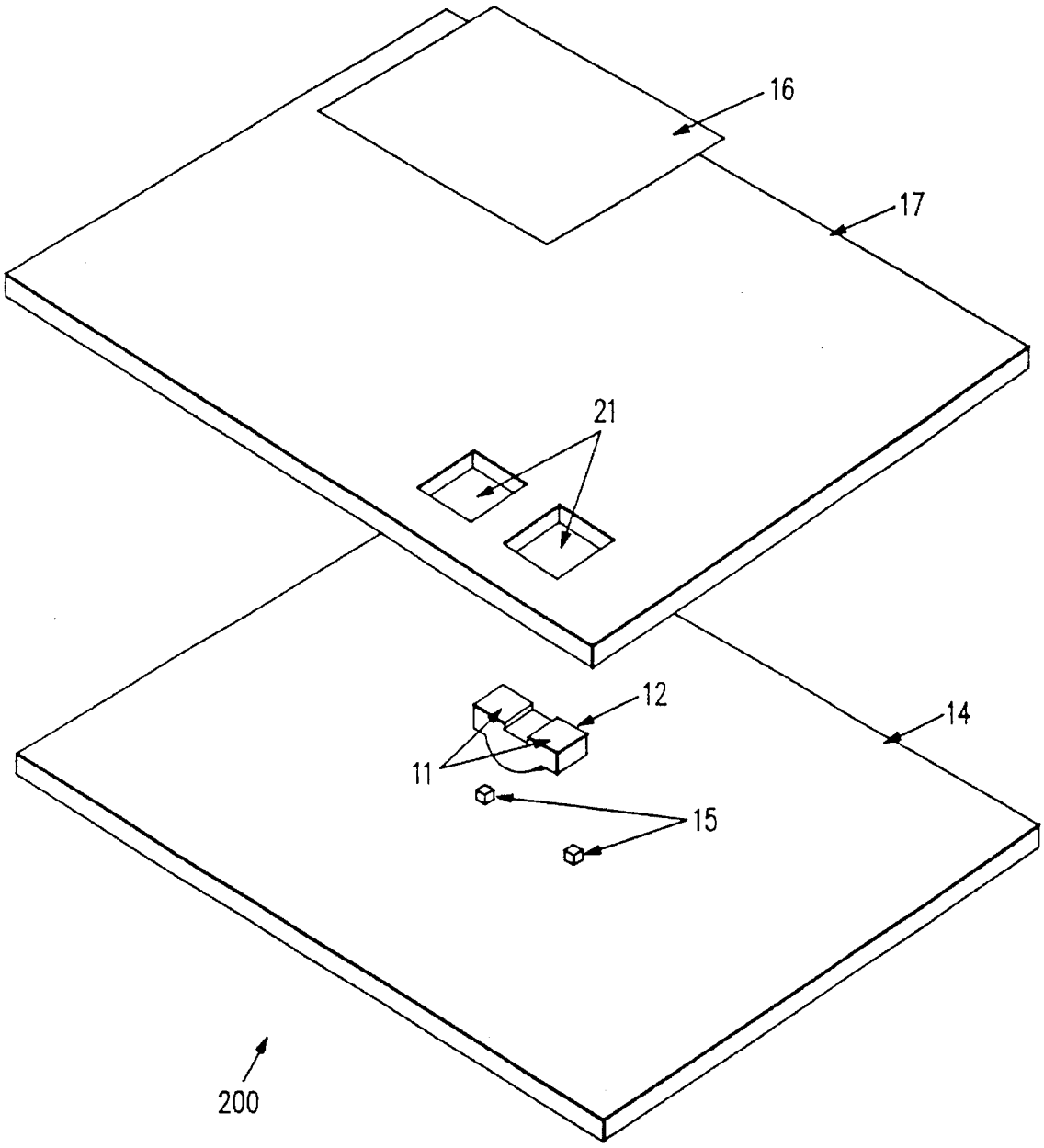
FIG. 2 is a perspective assembly view of the key switch of FIG. 1.

FIG. 1 illustrates a first embodiment of a pressure-compensated key switch, referred to by the reference number 200, having two keys balanced on a pivot line 18. A housing 17 encloses and provides support for the key switch 200. The housing 17 has two key apertures 21 covered on the outside and sealed to be waterproof by a flexible membrane 16. The flexible membrane 16 is identified by marks so that a user will know which areas to press on the key switch 200 to get a desired result. A pivot/switch support 14 mounts to the inside of the housing 17. Two switch mechanisms 15 mount to the pivot/switch support 14. A key body 12 has two key surfaces 11 that extend through the key apertures 21 and come into contact with or close proximity to the flexible membrane 16, two switch drivers 19 in contact with or in close proximity to the two switch mechanisms 15, and the pivot line 18 supported by the pivot/switch support 14. When the flexible membrane 16 is pressed in an area over one of the key surfaces 11, one of the switch drivers 19 compresses and actuates one of the switch mechanisms 15. The key body 12 rocks back and forth like a teeter-totter on the pivot/switch support 14 as one or the other key surface 11 is pressed and released. An optional light source 20 provides illumination from below by shining through the key body 12 and flexible membrane 16 to outline the area and identification of the key. FIG. 2 illustrates an assembly drawing of the key switch 200 showing the key body 12, the key surfaces 11, the switch mechanisms 15, the pivot/switch support 14, the housing 17, the flexible membrane 16, and the key apertures 21.

Figure 3:
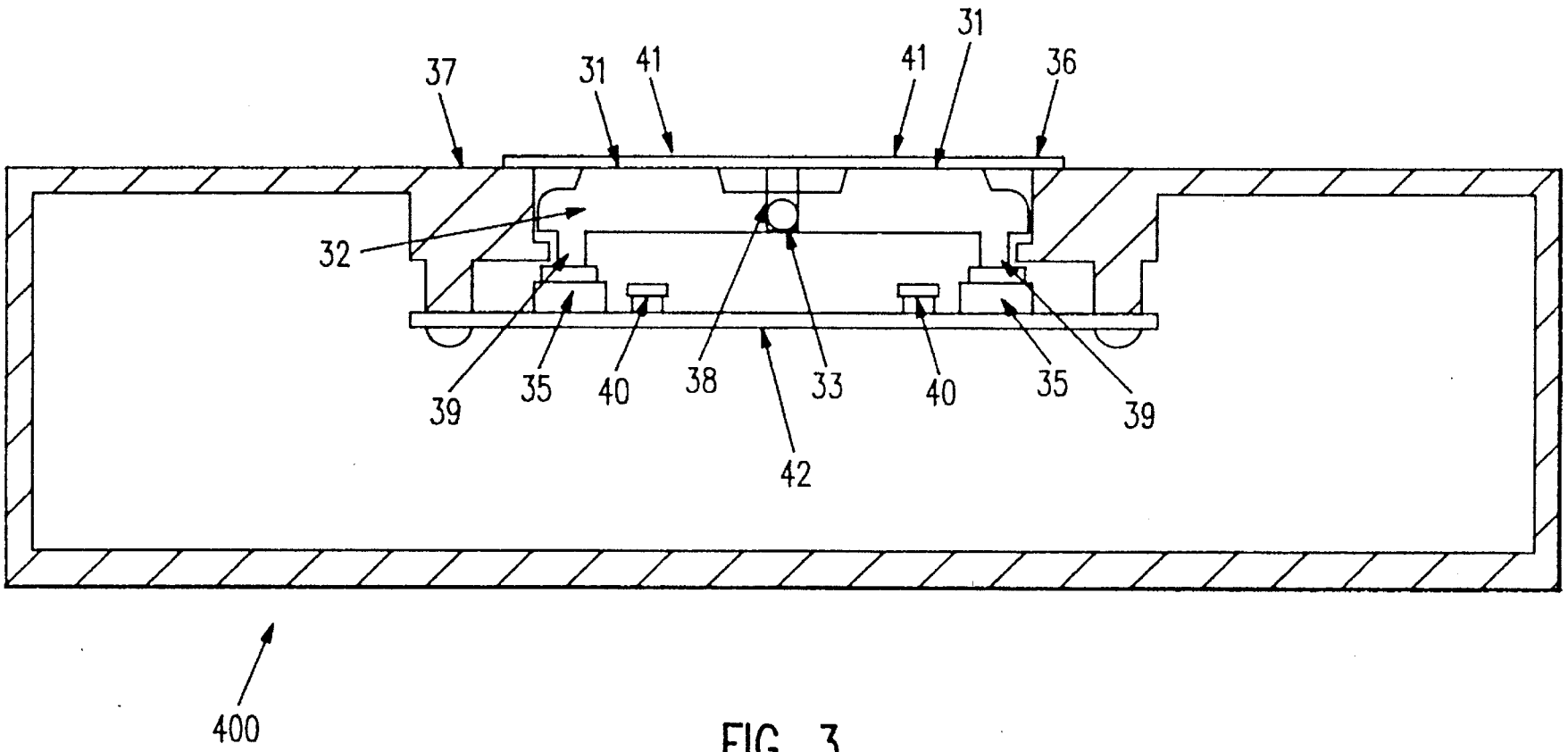
FIG. 3 is a side cross section view of a second embodiment of a pressure-compensated key switch of the present invention having a pivot pin about which the key switch pivots.
Figure 4:
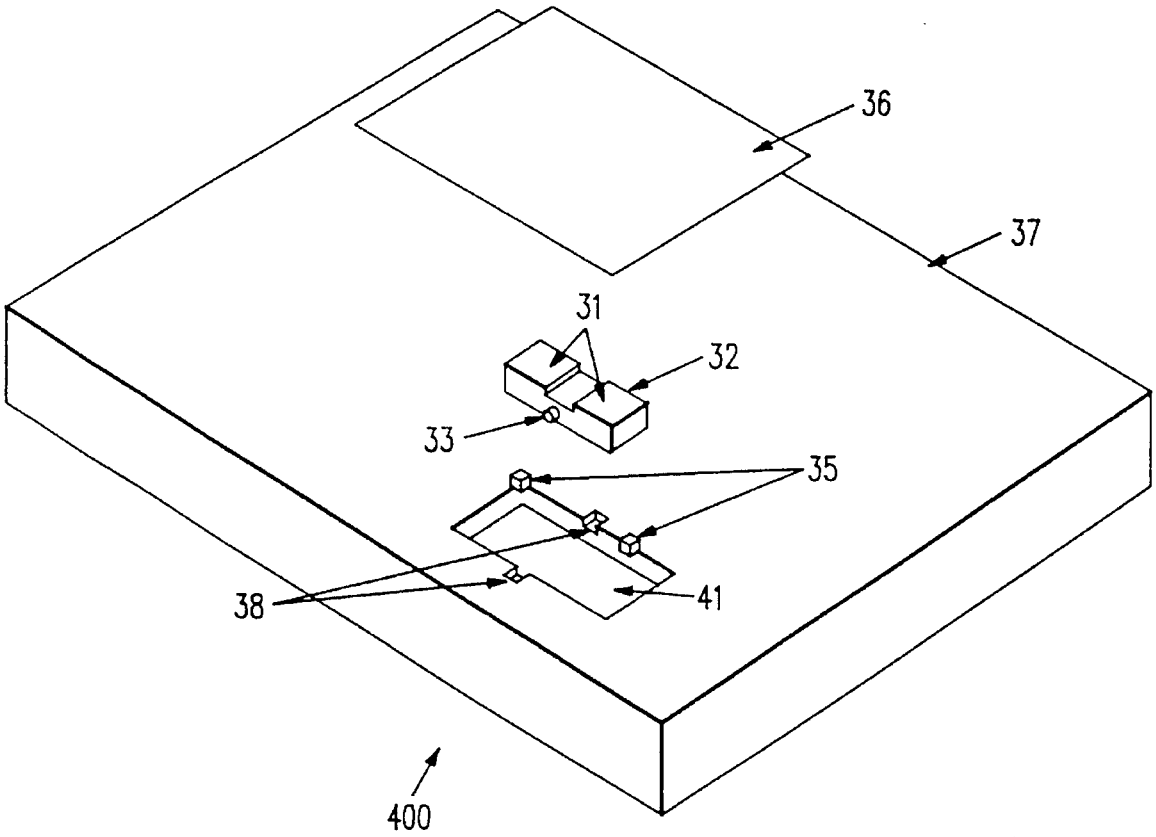
FIG. 4 is a perspective view of the key switch of FIG. 3.

FIG. 3 illustrates a second embodiment of a pressure-compensated key switch, referred to by the reference number 400, having two keys balanced on a pivot pin 33. A housing 37 encloses and provides support for the key switch 400. The housing 37 has a key aperture 41 that is covered on the outside and sealed to be waterproof by a flexible membrane 36 and two pivot supports 38 one on each of two opposite sides of the key aperture 41. The flexible membrane 36 is identified by marks so that a user will know which areas to press to get a desired result. A switch support 42 mounts to the inside of the housing 37. Two switch mechanisms 35 mount to the switch support 42. A key body 32 has two key surfaces 31 that extend through the key aperture 41 and come into contact with or close proximity to the flexible membrane 36, two switch drivers 39 in contact with or in close proximity to the two switch mechanisms 35, and two pivot pins 33 supported by the pivot support 38. When the flexible membrane 36 is pressed in the area over one of the key surfaces 31, one of the switch drivers 39 compresses and actuates one of the switch mechanisms 35. The key body 32 rocks back and forth like a teeter-totter on the pivot support 38 as one or the other of the key surfaces 31 is pressed and released. An optional light source 40 provides illumination from below by shining through the key body 32 and flexible membrane 36 to outline the area and identification of the key. FIG. 4 illustrates an assembly drawing of the key switch 400 showing the key body 32, the key surfaces 31, the switch mechanisms 35, the pivot support 38, the housing 37, the flexible membrane 36, and the key apertures 41.

Figure 5:
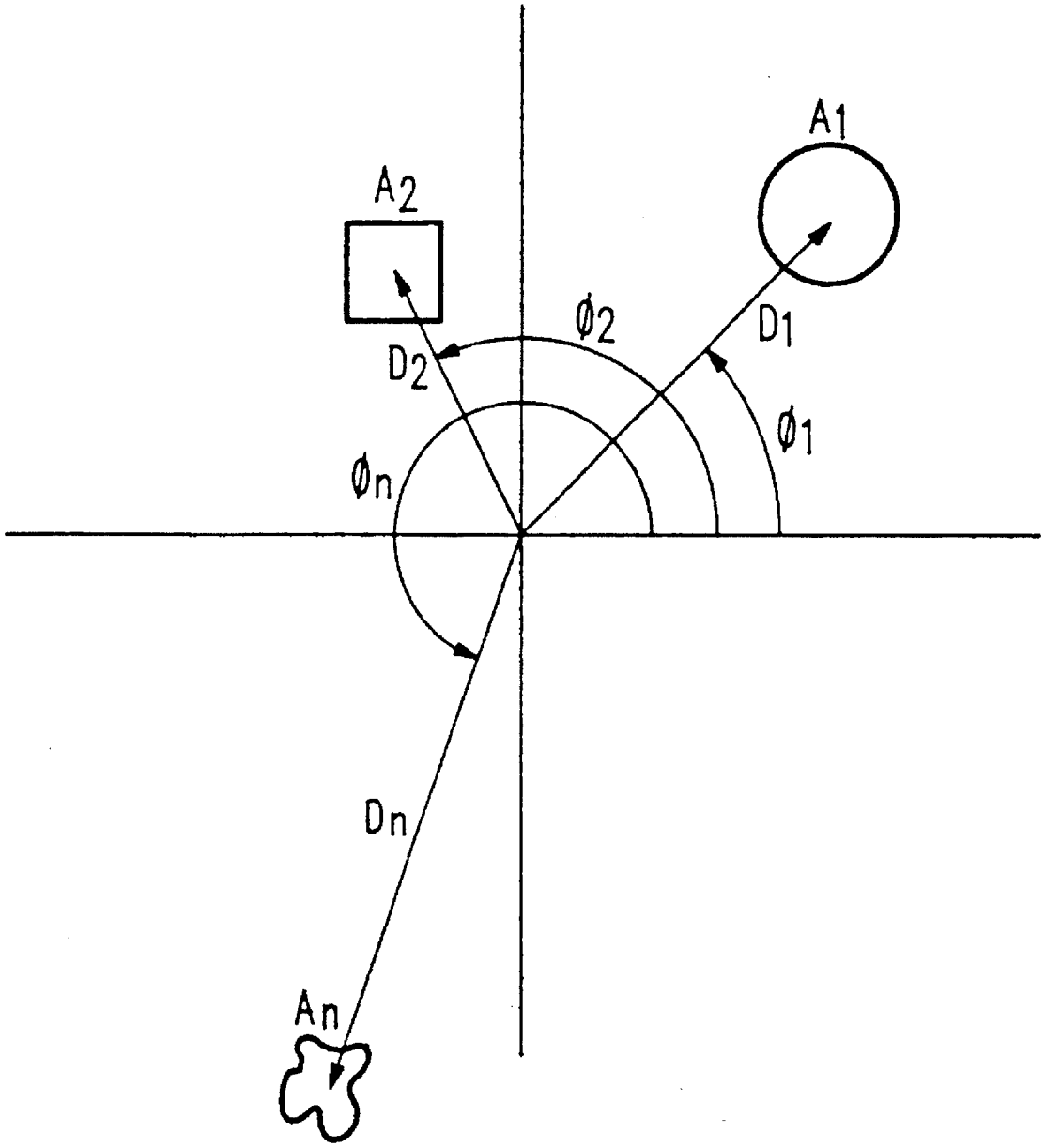
FIG. 5 is an x–y drawing of an arbitrary arrangement of key surfaces in a third embodiment of a pressure-compensated key switch of the present invention having a pivot point about which the key switch pivots.

A third embodiment of a pressure-compensated key switch may include any number of keys greater than one balanced on a pivot point. In general, the third embodiment may include keys with unequal surface areas with arbitrary shapes, at unequal distances from the pivot, and at any angle about an pivot, except as related to surface area in equations (1) and (2) below. FIG. 5 illustrates the geometry of a key switch with 3 keys (1, 2, and n) with independent key surface areas ($A_1$, $A_2$, and $A_n$) and arbitrary shapes, at unequal distances from the pivot point ($D_1$, $D_2$, $D_n$) to the center of the area, and with unequal angles ($\Phi_1$, $\Phi_2$, and $\Phi_n$) about the pivot.

The keys of the third embodiment are arranged about a center pivot point so that their combined moment or "area-weighted center of gravity" is zero. Equations (1) and (2) define the required symmetry for the proper balanced operation for the pressure-compensated key switch with n keys where n>1.

$$0 = \sum_{k=2}^{n} D_k A_k \operatorname{Sin}\Phi_k \quad (1)$$

$$0 = \sum_{k=2}^{n} D_k A_k \operatorname{Cos}\Phi_k \quad (2)$$

where n is the number of keys and n>1.

$D_k$ is the distance from the pivot point to the center of the key surface area for each key, k.

$A_k$ is the key surface area for each key, k.

$\Phi_k$ is the polar angle to the center of the surface area for each key, k.

Equations (1) and (2) require that the origin ($D_k$=0) is the center of gravity of the n keys, weighted by the key surface areas, $A_k$, of each key, k. Equations (1) and (2) thus define a location or an origin that is the "area-weighted center of gravity" of the n keys.

Figure 6:
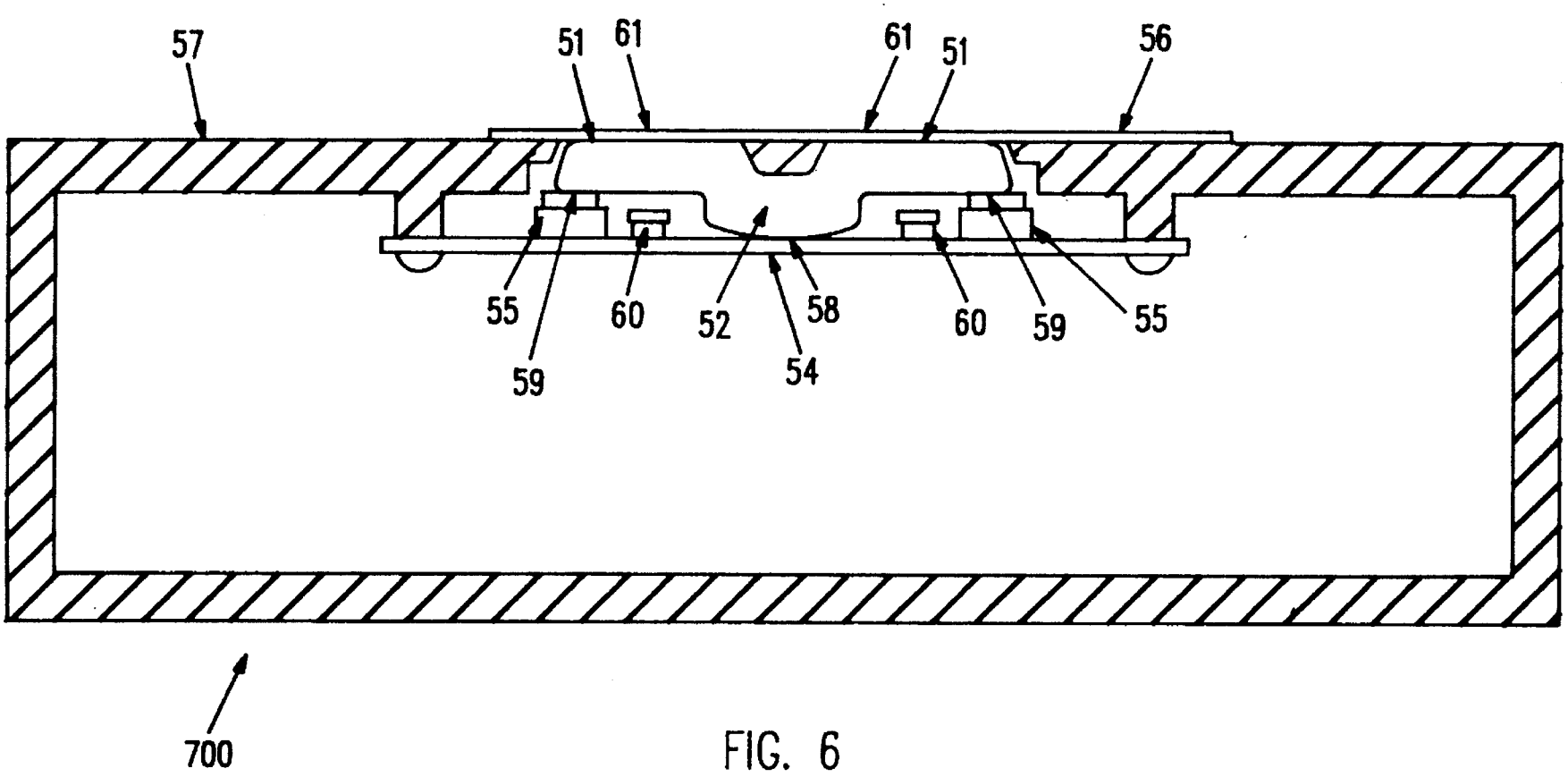
FIG. 6 is a side cross section view of the key switch of FIG. 5.
Figure 7:
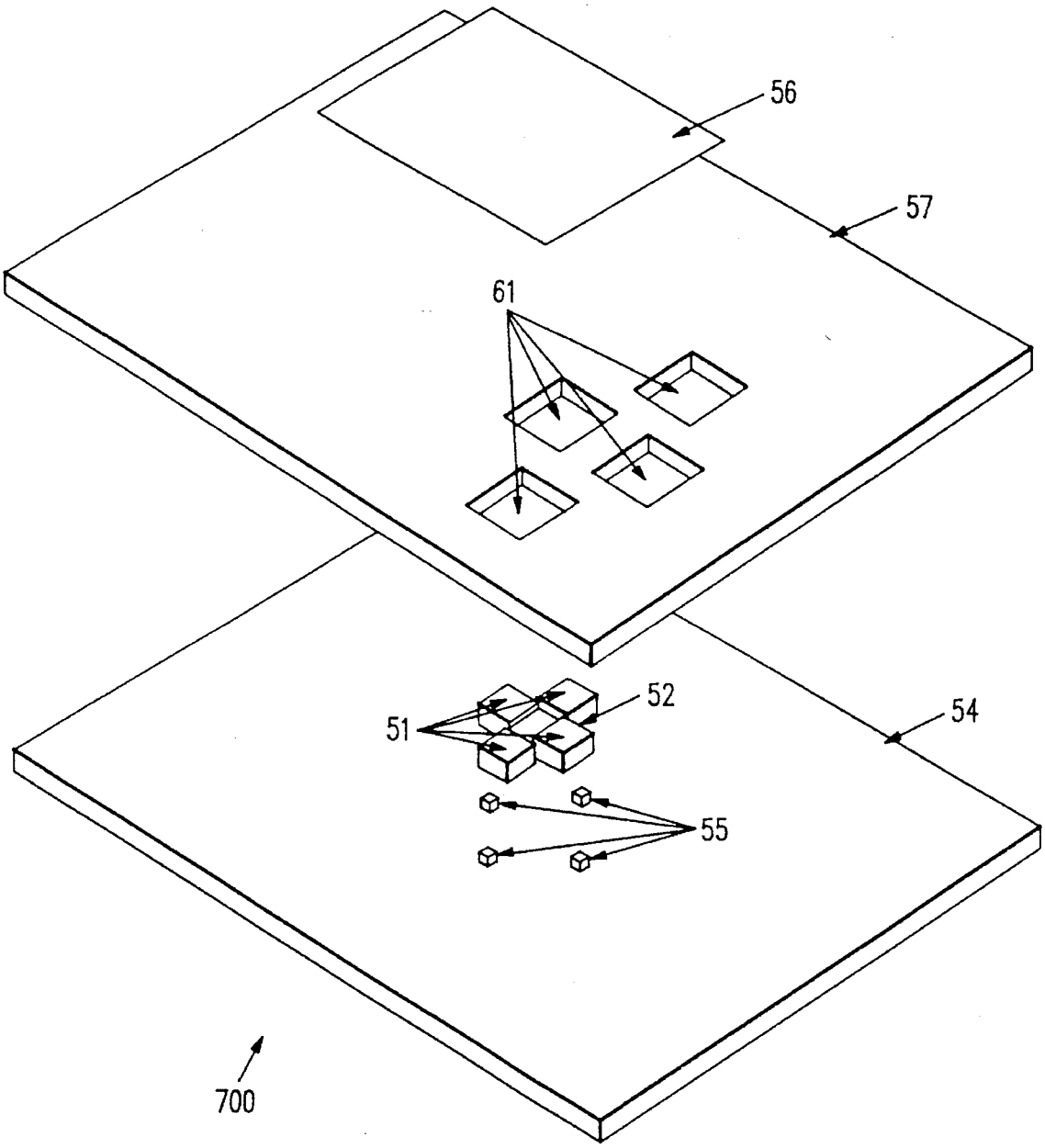
FIG. 7 is a perspective view of the key switch of FIG. 6.

FIG. 6 illustrates the third embodiment of a pressure-compensated key switch referred to by the reference number 700, where n=4. The four keys are balanced on a pivot point 58. A housing 57 encloses and provides support for the key switch 700. The housing 57 has four key apertures 61 covered on the outside and sealed to be waterproof by a flexible membrane 56. The flexible membrane 56 is identified by marks so that a user will know which areas to press on the key switch 700 to get a desired result. A pivot/switch support 54 mounts to the inside of the housing 57. Four switch mechanisms 55 mount to the pivot/switch support 54. A key body 52 has four key surfaces 51 that extend through the key apertures 61 and come into contact with, or are in close proximity to the flexible membrane 56, two switch drivers 59 in contact with or in close proximity to, the four switch mechanisms 55, and a pivot point 58 supported by the pivot/switch support 54. The key body 52 is given a point or a radius at the pivot point 58 so that the pivot point 58 will roll upon the pivot/switch support 54. When the flexible membrane 56 is pressed in an area over one of the key surfaces 51, one of the switch drivers 59 compresses and actuates one of the switch mechanisms 55. The key body 52 rocks back and forth like a teeter-totter on the pivot/switch support 54 as one or the other key surface 51 is pressed and released. An optional light source 60 provides illumination from below by shining through the key body 52 and flexible membrane 56 to outline the area and identification of the key. FIG. 7 illustrates an assembly drawing of the key switch 700 with n=4, showing the key body 52, the key surfaces 51, the switch mechanisms 55, the pivot/switch support 54, the housing 57, the flexible membrane 56, and the key apertures 61.

While preferred embodiments of the invention have been shown and described, it will be apparent to those skilled in this art that various modifications and extensions may be made in these embodiments without departing from the present invention.

We claim:

1. A key switch comprising:

a housing having an exterior, a hollow interior, and two key apertures spaced apart from each other;

a flexible membrane that covers the key apertures on the exterior of the housing;

a pivot/switch support mounted to the hollow interior of the housing;

a key body having an elongated body, a top, a bottom, and two opposite ends, the key body comprising:

a first and a second key surface on the key body top in each opposite end, where the key surfaces (i) extend through the key apertures in the housing to be adjacent to the flexible membrane and (ii) have approximately equal surface areas;

a first and a second switch driver on the key body bottom in each opposite end; and a pivot line on the key body bottom, positioned approximately mid-way between the two key surfaces, the pivot line to have a line of contact with the pivot/switch support; and a first and a second switch mechanism, each with a top and a bottom, the bottoms being supported by the pivot/switch support, the tops adjacent to first and second switch drivers, respectively, where the switch mechanism actuates when compressed between the switch driver and the pivot/switch support;

whereby, a light force applied through the flexible membrane upon one of the key surfaces will cause the key body to pivot about the line of contact between the pivot line and the pivot/switch support and cause one of the switch drivers to exert a compressing force on one of the switch mechanisms so that the switch mechanism actuates, and whereby a large pressure applied through the flexible membrane upon both of the key surfaces approximately equally will not actuate either of the switch mechanisms.

2. The key switch of claim 1, wherein said flexible membrane is marked with identification of at least one key surface.

3. The key switch of claim 1, further comprising at least one light source positioned below said key body, to shine through at least one of said key body and said flexible membrane.

4. The key switch of claim 3, wherein said light source is a light emitting diode (LED).

5. The key switch of claim 3, wherein said light source is an electroluminescent (EL) light.

6. The key switch of claim 1, wherein said flexible membrane is part of a waterproof seal to said housing.

7. The key switch of claim 1, wherein said pivot/switch support is a printed circuit board.

8. A key switch comprising:

a housing having an exterior, a hollow interior, a key aperture, and two pivot supports, one pivot support on each side of the key aperture;

a flexible membrane that covers the key aperture on the exterior of the housing;

a key body having an elongated body, a top, a bottom, two sides, and two opposite ends, the key body comprising:

a first and a second key surface on the key body top in each opposite end, where the key surfaces (i) extend through the key aperture in the housing to be adjacent to the flexible membrane and (ii) have approximately equal surface areas;

a first and a second switch driver on the key body bottom in each opposite end; and two pivot pins, one on each side of the key body, positioned approximately mid-way between the two key surfaces, the pivot pins supported and free to rotate on the pivot supports in the housing;

a switch support mounted to the hollow interior of the housing; and a first and a second switch mechanism, each with a top and a bottom, the bottoms being supported by the switch support, the tops adjacent to first and second switch drivers, respectively, where the switch mechanism actuates when compressed between the switch driver and the pivot/switch support;

whereby, a light force applied through the flexible membrane upon one of the key surfaces will cause the key body to rotate about the pivot pins supported by the pivot supports to cause one of the switch drivers to exert a compressing force on one of the switch mechanisms so that the switch mechanism actuates, and whereby a large pressure applied through the flexible membrane upon both of the key surfaces approximately equally will not actuate either of the switch mechanisms.

9. The key switch of claim 8, wherein said flexible membrane is marked with identification of at least one key surface.

10. The key switch of claim 8, further comprising at least one light source positioned below said key body, to shine through at least one of said key body and said flexible membrane.

11. The key switch of claim 10 wherein said light source is an light emitting diode (LED).

12. The key switch of claim 10 wherein said light source is an electroluminescent (EL) light.

13. The key switch of claim 8, wherein said flexible membrane is part of a waterproof seal to said housing.

14. The key switch of claim 8, wherein said switch support is a printed circuit board.

15. A key switch comprising:

a housing having an exterior, a hollow interior, and four key apertures spaced apart from each other;

a flexible membrane that covers the four key apertures on the exterior of the housing;

a pivot/switch support mounted to the hollow interior of the housing;

a key body having a cross shaped body with a first and a second pair of opposite ends, a top, and a bottom, the key body comprising:

a first and a second key surface on the key body top in the first opposite ends, where the key surfaces (i) extend through the key apertures in the housing to be adjacent to the flexible membrane and (ii) have approximately equal surface areas;

a third and a fourth key surface on the key body top in the second opposite ends, where the key surfaces (i) extend through the key apertures in the housing to be adjacent to the flexible membrane and (ii) have approximately equal surface areas;

a first, a second, a third, and a fourth switch driver on the key body bottom in each of each pair of opposite ends; and a pivot point on the key body bottom, located approximately at the intersection of the line joining the centers of the first and second key surfaces with the line joining the centers of the third and fourth key surfaces, the pivot point to have a point of contact with the pivot/switch support; and a first, a second, a third, and a fourth switch mechanism, each with a top and a bottom, the bottoms being supported by the pivot/switch support, the tops adjacent to first second, third, and fourth switch drivers, respectively, where the switch mechanism actuates when compressed between the switch driver and the pivot/switch support;

whereby, a light force applied through the flexible membrane upon one of the key surfaces will cause the key body to pivot about the point of contact between the pivot point and the pivot/switch support and cause one of the switch drivers to exert a compressing force on one of the switch mechanisms so that the switch mechanism actuates, and whereby a large pressure applied through the flexible membrane upon all four of the key surfaces approximately equally will not actuate any of the switch mechanisms.

16. The key switch of claim 15, wherein said flexible membrane is marked with identification of at least one key surface.

17. The key switch of claim 15, further comprising at least one light source positioned below said key body, to shine through at least one of said key body and said flexible membrane.

18. The key switch of claim 17, wherein said light source is a light emitting diode (LED).

19. The key switch of claim 17, wherein said light source is an electroluminescent (EL) light.

20. The key switch of claim 15, wherein said flexible membrane is part of a waterproof seal to said housing.

21. The key switch of claim 15, wherein said pivot/switch support is a printed circuit board.

22. A key switch having n keys, where n is two or more, comprising:

a housing having an exterior, a hollow interior, and n key apertures spaced apart from each other;

a flexible membrane that covers the n key apertures on the exterior of the housing;

a pivot/switch support mounted to the hollow interior of the housing;

a key body having a body, a top, a bottom, and n ends, the key body comprising:

n key surfaces on the key body top in each of the n ends, where the n key surfaces extend through the n key apertures in the housing to be adjacent to the flexible membrane;

n switch drivers on the key body bottom in each of the n ends; and a pivot point on the key body bottom, at a selected position that is the area-weighted center of gravity of the n key surfaces, the pivot point to have a point of contact with the pivot/switch support; and n switch mechanisms, each with a top and a bottom, the bottoms being supported by the pivot/switch support, the tops adjacent to the n switch drivers, respectively, where the switch mechanism actuates when compressed between the switch driver and the pivot/switch support;

whereby, a light force applied through the flexible membrane upon one of the key surfaces will cause the key body to pivot about the point of contact between the pivot point and the pivot/switch support and cause one of the switch drivers to exert a compressing force on one of the switch mechanisms so that the switch mechanism actuates, and whereby a large pressure applied through the flexible membrane upon all n of the key surfaces approximately equally will not actuate any of the switch mechanisms.

23. The key switch of claim 22, wherein said flexible membrane is marked with identification of at least one key surface.

24. The key switch of claim 22, further comprising at least one light source positioned below said key body, to shine through at least one of said key body and said flexible membrane.

25. The key switch of claim 24, wherein said light source is a light emitting diode (LED).

26. The key switch of claim 24, wherein said light source is an electroluminescent (EL) light.

27. The key switch of claim 22, wherein said flexible membrane is part of a waterproof seal to said housing.

28. The key switch of claim 22, wherein said pivot/switch support is a printed circuit board.

* * * * *